United States Patent [19]

Robinson et al.

[11] Patent Number: 4,720,959

[45] Date of Patent: Jan. 26, 1988

[54] CONTINUOUS CASE PACKER

[75] Inventors: Chris E. Robinson, Akron; Robert W. McGill, Munroe Falls, both of Ohio

[73] Assignee: Figgie International, Richmond, Va.

[21] Appl. No.: 928,574

[22] Filed: Nov. 10, 1986

Related U.S. Application Data

[63] Continuation of Ser. No. 796,566, Nov. 8, 1985, abandoned.

[51] Int. Cl.[4] ..... B65B 5/00

[52] U.S. Cl. ..... 53/247; 53/251

[58] Field of Search ..... 53/247, 249, 250, 251, 53/282, 55, 67, 493, 147, 494, 248; 198/346.1, 468.8, 346.2, 579, 429, 461

[56] References Cited

U.S. PATENT DOCUMENTS

| | | | |
|---|---|---|---|
| 2,978,854 | 4/1961 | Fairest | 53/247 X |
| 3,353,331 | 11/1967 | Rouekamp | 53/249 X |
| 3,901,376 | 8/1975 | Dardaine et al. | 53/247 |
| 4,055,943 | 11/1977 | Reichert | 53/247 |
| 4,203,271 | 5/1980 | Raudat | 53/250 |
| 4,446,672 | 5/1984 | Raudat | 53/247 X |
| 4,457,121 | 7/1984 | Johnson et al. | 53/247 X |
| 4,459,794 | 7/1984 | Raudat | 53/247 X |
| 4,494,355 | 1/1985 | Johnson et al. | 53/247 X |
| 4,506,493 | 3/1985 | Horton | 53/247 X |
| 4,569,181 | 2/1986 | Raudat | 53/251 |

FOREIGN PATENT DOCUMENTS

| | | |
|---|---|---|
| 724515 | 2/1955 | United Kingdom . |
| 747140 | 3/1956 | United Kingdom . |
| 831476 | 3/1960 | United Kingdom . |
| 911682 | 11/1962 | United Kingdom . |
| 2079710 | 1/1982 | United Kingdom . |

*Primary Examiner*—Robert L. Spruill
*Assistant Examiner*—Steven P. Weihrouch
*Attorney, Agent, or Firm*—Oldham, Oldham & Weber, Co.

[57] ABSTRACT

A continuous case packer for receiving an ongoing stream of cases and containers and causing the containers to be deposited into the cases. The cases are fed on a conveyor assembly comprising an in-feed section, a staging section, and an out-feed section. The staging section and out-feed section are mechanically linked by sprocketing and each includes lugs for positively driving the cases received therein. The lugs are timed for continuous operation of receipt of cases from the staging area, filling of the cases, and removal of the cases from the case out-feed section. The case in-feed section includes a unique case stop and brake mechanism allowing for rapid movement of the incoming cases while providing for separation of the lead case to be fed to the staging section.

20 Claims, 3 Drawing Figures

CONTINUOUS CASE PACKER

CROSS REFERENCE TO RELATED APPLICATION

This application is a continuation of Ser. No. 796,566 filed Nov. 8, 1985 and now abandoned.

TECHNICAL FIELD

The invention herein resides in the art of article handling equipment. More particularly, the invention relates to a case packer for automatically and continuously receiving an on-coming stream of cases and containers such as bottles or cans. The case packer operates to deposit the containers into the cases at high speeds and on an on-going basis.

BACKGROUND ART

Case packers have been well known in the article handling art for many years. In such case packers, it has been known to provide an in-coming stream of containers such as bottles and a similar in-coming stream of cases. In many known systems, the containers are received and transported by a conveyor positioned above a somewhat similar conveyor which receives and transports the cases. The containers are received by a packing head or fill head which is positioned above a packing station which, in many instances, includes a case lift for elevating the case to a position immediately below the fill head for receiving the containers.

In the prior art, case packers have generally operated on a start/stop basis, and have not been characterized by a continuous operation of the conveyor for both the cases and containers.

The prior art is further devoid of a case packer wherein there is a positive action clearing of cases from the case lift station of the packer and wherein both a staging area and a case lift area are mechanically tied together to attain positive action therebetween. Absent this type of structure, the prior art case packers have generally been slow in operation and, to some degree, unreliable. Yet further, the prior art has typically taught a case in-feed section wherein cases were singlely fed to the case packer, but moved only by the frictional engagement of the case with the conveyor chain. Slippage between the case and the chain typically resulted in a delay in case movement and an inherent slowness in operation of the case packer.

DISCLOSURE OF THE INVENTION

In light of the foregoing, it is a first aspect of the invention to provide a continuous case packer which is rapid in operation, substantially eliminating the start/-stop operation of the prior art.

Another aspect of the invention is the provision of a continuous case packer wherein a detailed check of system operations is made on each packing cycle.

Still a further aspect of the invention is the provision of a continuous case packer wherein there is provided a positive action clearing of cases at the case lift station.

An additional aspect of the invention is the provision of a continuous case packer wherein a staging area and case lift area are mechanically tied together to assure positive and related movements of cases therebetween.

Yet another aspect of the invention is the provision of a continuous case packer wherein a large compliment of cases is allowed to move together at a case in-feed station for prompt response to a request for a case at the staging area.

Still another aspect of the invention is the provision of a continuous case packer which may readily be constructed from state of the art elements, which is rapid and efficient in operation, and which is economical to manufacture and operate.

The foregoing and other aspects of the invention which will become apparent as the detailed description proceeds are achieved by a case packer, comprising: a first conveyor assembly for receiving and transporting containers; a packing head at an end of said first conveyor assembly for receiving the containers in an ordered arrangement; and a second conveyor assembly for receiving and transporting cases to a position beneath said packing head, said second conveyor assembly comprising first and second conveyor sections which are interconnected and exclusively operable together.

Other aspects of the invention are attained by a packer for receiving an oncoming supply of cases and containers and for depositing said containers into said cases, comprising: a container conveyor for receiving said containers at a first end thereof and transporting said containers to a fill head positioned at a second end thereof; a case in-feed conveyor for receiving said cases at a first end thereof and transporting said cases in an abutting linear order to a second end thereof; a staging conveyor having a first end thereof in case-receiving communication with said second end of said case in-feed conveyor for transporting said cases to a second end thereof; a case out-feed conveyor maintained beneath said fill head and having a first end thereof in case-receiving communication with said second end of said staging conveyor; case stop means positioned at said second end of said case in-feed conveyor for stopping and releasing said linear order of cases by selectively engaging and releasing a lead case of said linear order of cases; case brake means adjacent said case in-feed conveyor for stopping and releasing said linear order of cases by selectively engaging and releasing a lead case of said linear order of cases; and case brake means adjacent said case in-feed conveyor for stopping and releasing said linear order of cases by selectively engaging and releasing a second case immediately adjacent said lead case, said case brake means engaging said second case after release of said lead case by said case stop means.

DESCRIPTION OF THE DRAWINGS

For a complete understanding of the objects, techniques, and structure of the invention reference should be had to the following detailed description and accompanying drawings wherein.

BEST MODE FOR CARRYING OUT THE INVENTION

Figure 1:
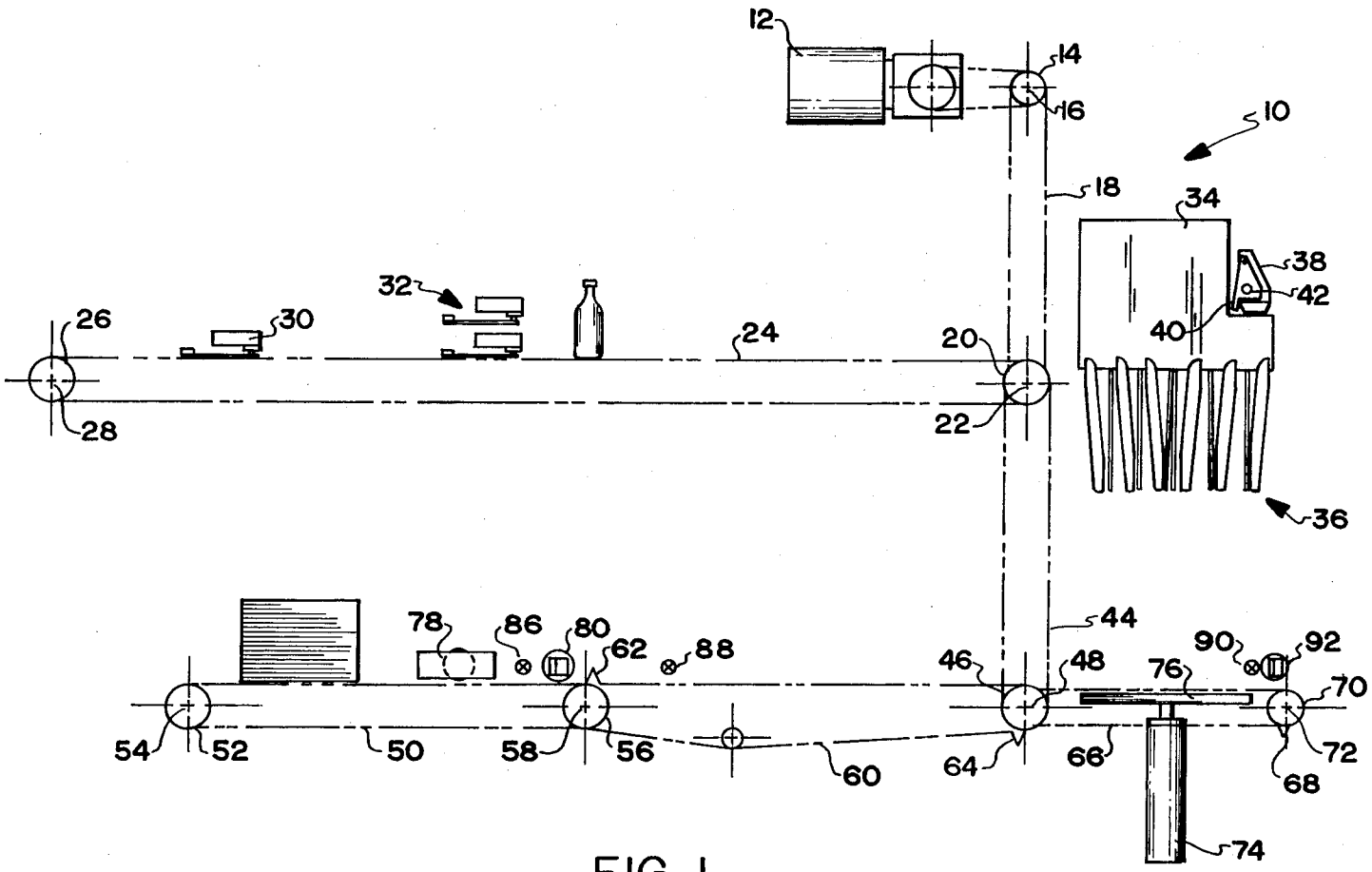
FIG. 1 is a side illustrative view of a continuous case packer according to the invention.

Referring now to the drawings and more particularly FIG. 1, it can be seen that a continuous case packer according to the invention is designated generally by the numeral 10. The main drive for the conveyor portions of the case packer 10 is provided by means of an electric motor 12 which drives a sprocket on a gang of sprockets 14 maintained upon a shaft 16. A chain 18 extends from one of the sprockets 14 on the shaft 16 to one of the sprockets of a gang of sprockets 20 maintained upon the shaft 22. Another sprocket from the gang 22 drives the bottle feed chain 24.

As is well known in the art, the chain 24 may comprise a table top chain receiving bottles or other containers thereon and for conveying the bottles from the left to the right as shown in FIG. 1. The other end of the chain is received upon an idle sprocket or roller 26 maintained upon a shaft 28 such that a continuous conveyor action is attained. It will be understood by those skilled in the art that lane dividers and the like would normally be positioned in association with the conveyor chain 24. Bottles would typically be received in mass at the left end of the conveyor chain 24 as shown in FIG. 1 and then be divided into lanes corresponding to the spacing of receptacles in the cases in which the bottles are to be placed. Also associated with the chain 24 is a bottle supply switch 30 which monitors the presence of the bottles as they move in mass toward the lane dividers. Typically, the switch 30 would be a mechanical limit switch. Also positioned along the conveyor chain 24 and adjacent the lane dividers are agitators and switches 32. These elements also monitor the movement of the bottles through the lanes of the lane dividers. In the event that either of the switches 30,32 sense a jam of bottles, the agitators 32 are caused to agitate the lane dividers to breakup the jam. Such a switching and agitating technique is now known in the art.

The conveyor chain 24 moves the bottles through the lane dividers to a fill head or packing head 34. Such packing heads are well known in the art and typically include a plurality of fingers 36 extending from the bottom thereof to direct the bottles into a case to be received therebelow. A fill head safety 38 is provided in association with each lane of bottles being received. The fill head safety is characterized by a flag 40 for each lane, the flags 40 being operative to make or break the light passage of a photodetector assembly 42. In standard fashion, the assembly 42 would include a light source and a detector. As is well known in the art, when a full compliment of bottles is received in the fill head 34, a light path is opened between the light source and sensor of the assembly 42, indicating that sufficient bottles are present for filling a case. Skid bars in the filling head are then shifted and the bottles dropped through the fingers 36 and into the case.

With further reference to FIG. 1, it can be seen that a chain 44 is interconnected between a sprocket of the gang of sprockets 20 and a sprocket of a gang of sprockets 46 maintained upon a shaft 48. The chain 44 achieves the driving of the case transport section of the invention in a manner to be discussed directly below.

Figure 2:
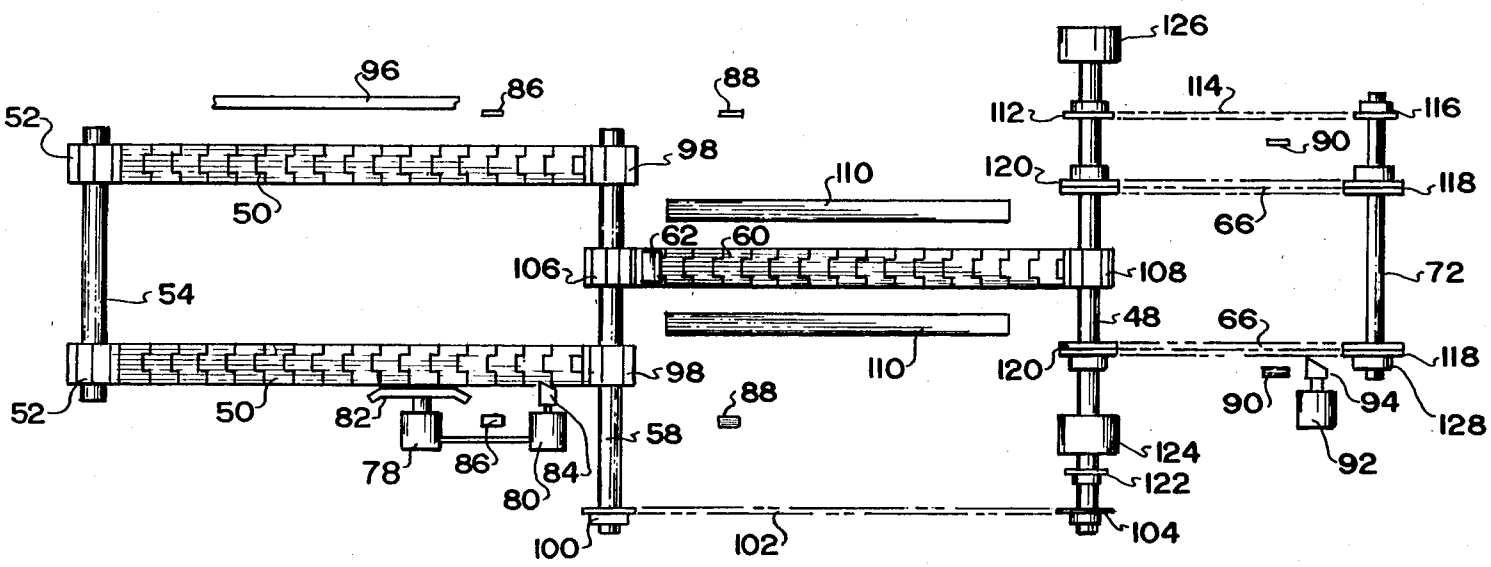
FIG. 2 is a top illustrative view of the case in-feed, staging, and case lift portions of the continuous case packer of FIG. 1.

As seen in FIGS. 1 and 2, the case transporting system of the invention comprises three separate sections, an in-feed section, a staging section, and a case packing station or out-feed section. The case in-feed section is defined by a pair of table top chains 50 maintained upon and rotatable between idle sprockets or rollers 52 maintained upon a shaft 54 and a pair of sprockets of a gang of sprockets 56 maintained upon a shaft 58.

A staging area is defined by a single table top chain 60 having a pair of lugs 62,64 spaced apart so as to divide the chain 60 into two equal sections. In a preferred embodiment of the invention, the chain 60 is 120" in length, with the lugs 62,64 being 60" apart. It will be noted that the chain 66 is rotatable between a sprocket of the gang of sprockets 56 on the shaft 58 and a sprocket of the gang of sprockets 46 on the shaft 48.

The case out-feed or case packing station is defined by a pair of roller chains 66 each having a single lug 68 thereon. The chains 66 are caused to be driven between sprockets or rollers of the gang 46 on the shaft 48 and those of the gang 70 on the shaft 72. In the preferred embodiment of the invention, the chains 66 are 72" long and are such as to make a single revolution each time the chain 60 makes one half of a revolution. This, of course, is attained by the gearing of the respective chains and sprockets as will become apparent hereinafter.

Maintained beneath the chain 66 is a case lift cylinder 74 having a case lift platform 76 connected thereto. The platform 76 is operative to extend upward either between or on either side of the chains 66 for purposes of lifting cases toward the fill head 34 in somewhat standard fashion.

With further reference to FIGS. 1 and 2, it can be seen that a case brake 78 and a case stop 80 are provided at the end of the in-feed section defined by the chains 50. As shown in FIG. 2, case brake 78 is a pneumatic cylinder having a brake shoe 82 connected to the piston thereof. In like manner, the case brake 80 is a pneumatic cylinder having a stop pad 84 connected to the piston thereof. As shown, and as will become apparent hereinafter, the case brake 78 and stop 80 are pneumatically interconnected to operate in tandem. As will further be discussed, the case brake 78 includes a characteristic delay when actuated to extend the brake shoe 82, but pressure is dumped on the return stroke for immediate withdrawal of the shoe 82.

It will also be noted that a photodetector 86 is positioned between the case brake 78 and case stop 80, the photodetector 86 again constituting a light source and sensor traversing the case in-feed path. In similar fashion, a photodetector 88 is positioned across the staging area path defined by the chain 60 and a photodetector 90 is positioned across the end of the case lift portion defined by the chain 66. The operation of such photodetectors will be elaborated upon hereinafter.

A pneumatic case stop 92 having a pad 94 at the end of the piston thereof is provided at the end of the case lift section. As shown, the case stop 92 is beyond the photodetector 90 as considered with respect to the path of movement of the cases.

It will be appreciated that the drawings of FIGS. 1 and 2 are illustrative. Certain elements commonly existing in case packers are not shown or are only shown by way of representation. For example, a side rail 96 is positioned along the length of the case conveyor path defined by the chains 50,60,66. As further shown in FIG. 2, the actual drive mechanism of the various chains is shown. Driven sprockets 98 are keyed to the shaft 58 for receiving the pair of chains 50 which are also received by the idle sprockets or rollers 52 on the shaft 54. In like manner, a drive sprocket 100 is keyed to the end of the shaft 58 and communicates with the drive sprocket 104 keyed to the end of the shaft 48 by means of a chain 102. The shaft 48 is caused to rotate under control of the motor 12 as by interconnection of the chain 44 with the sprocket 122 as considered by combined reference to FIGS. 1 and 2.

An idle sprocket or roller 106 receives the chain 60 as does a drive sprocket 108 which is keyed to the shaft 48 and rotated therewith. As shown in FIG. 2, the chain 60 passes between a pair of skid bars 110 which are slightly elevated above the path of the surface of the chain 60, but beneath the path of the lug 62. Accordingly, cases may be positively moved along the skid bars 110 by the lugs 62,64 without contact with the chain 60.

A drive sprocket 112 is also keyed to an end of the shaft 48 for communicating with a drive sprocket 116, keyed to the shaft 72, via the chain 114. Also keyed to the shaft 72 are drive sprockets 118, each receiving one of the roller chains 66 which communicate with a respective idle roller 120 maintained upon the shaft 48.

It will be noted that a clutch 124 and a brake 126 are associated with the shaft 48. The clutch and brake operate off of the same pneumatic valve such that when the brake 126 is applied, the clutch 124 is released and, in like manner, when the clutch is engaged, the brake is released. It will be readily appreciated that the motor 12 driving the sprocket 122 will always cause rotational movement of the pair of chains 50 via the chain 102 and drive sprockets 98,100,104. However, only when the clutch 124 is engaged and the brake 126 released, will the motor 12 cause movement of the chains 60,66 via the drive sprockets 108,112, 116,118.

Also included as part and parcel of the invention is a cam switch 128 operated off of the shaft 72 to generate a cycle-check signal upon each rotation of the chains 66. The output signal from the cam switch 128 is applied to the controller 130 of FIG. 3 which will be discussed hereinafter.

With reference to FIGS. 1 and 2, consideration of the operation of the invention may now be undertaken. The motor 12 is energized and is operative to move the conveyor chain 24 in a clockwise direction as shown in FIG. 1. A mass of bottles or other containers received by the chain 24 are appropriately divided by associated lane dividers and introduced to the packing head 34. Concurrently, a mass of cases, linearly arranged, are introduced to the in-feed chain 50, the line of cases being stopped by the case stop 80. The lead case in the infeed line breaks the light of the photodetector 86, generating an appropriate output signal. In the staging area defined by the conveyor 60, a case is received in front of the lug 62 and blocking the light of the photodetector 88, causing the photodetector to emit an appropriate output signal. An empty case is also received at the fill head station defined by the conveyor roller chains 66, being stopped by the case stop 92 and blocking the light of the photodetector 90, generating an appropriate output signal. As discussed above, a full compliment of bottles is received by the fill head 34, actuating the fill head safety 38 such that the photodetector 42 provides the appropriate output signal. Finally, the bottle supply switch 30 presents an output signal indicating that bottles are present thereat for a subsequent case packing operation. If the photodetectors 86,88,90 indicate that cases are present thereat, and if the photodetector 42 indicates that the head 34 is full, and the switch 30 indicates that bottles are present at that point on the conveyor 24, the case lift 74 is actuated such that the platform 76 extends upwardly and lifts the case to a position directly beneath the fill head 34 with the skid bars of the fill head 34 being actuated to allow the bottles to drop through the fingers 36 and into the case. The platform 76 is then lowered to place the case onto the conveyor chains 76 for removal by the positive action of the lugs 68 onto a receiving conveyor or the like.

It will be understood that the conveyor chains 24,50,60,66 run continuously unless a malfunction is sensed. Accordingly, when the case lift 74 returns the case to the conveyor chains 66, the case is swept from the lift station by means of the lugs 68 on the chains 66. This positive action assures rapid removal of the case. At the same time, one of the lugs 62,64 on the chain 60 is moving a case from the staging area across the skid bars 110 and onto the chains 66 with the case being stopped by the case stop 92, ready for the next filling operation.

Concurrent with the transport of the case through the staging area and from the case lift area, the case stop 80 is released such that the line of cases at the in-feed portion upon the chains 50 are allowed to move. By allowing the entire compliment of abutting cases to move simultaneously, a larger mass is urged by the chains 50 than if only a single box were moved. Accordingly, the frictional engagement with the chains 50 is greater and movement of the cases is more rapidly responsive to the release of the stop 80. With the stop 80 and the case brake 78 being operated in tandem, release of the stop 80 actuates the brake 78 which, as discussed above, has a built-in time delay associated therewith. Accordingly, as soon as the stop 80 is released as by withdrawing the plunger and pad 84, the lead case enters the staging area and the brake shoe 82 begins its movement to transverse the in-feed line. The shoe 82 then contacts the second case in the line and urges it against the side rail 96, preventing further movement of the second case. When the photodetector 86 senses that the first case has cleared, the case stop 80 is reactuated to extend the pad 84 into the in-feed line. Simultaneously, the case brake 78 is released with an instantaneous dump of pressure so as to immediately release the shoe 82. Accordingly, the case held by the brake 78 is released to be stopped at the case brake 80. The chains 50, however, continue to run.

The operation of the case packer 10 is continuous. In normal operation, all of the conveyor chains are continuously running. The chain 60 is sprocketed and configured so as to make one complete revolution each time the chains 66 make two revolutions. The chains 66 make one complete revolution for each case-packing cycle. The lugs 62,64 of the chain 60 and the lugs 68 of the chains 66 are so positioned and mechanically interrelated as by operation off of the common shaft 48 that a new case is fed from the staging area by a lug 62,64 to the case lift area just after the filled case is removed from the case lift area by the lugs 68. Obviously, the case stop 92 is operated and timed so as to allow the filled case to depart and to stop the in-coming empty case.

Figure 3:
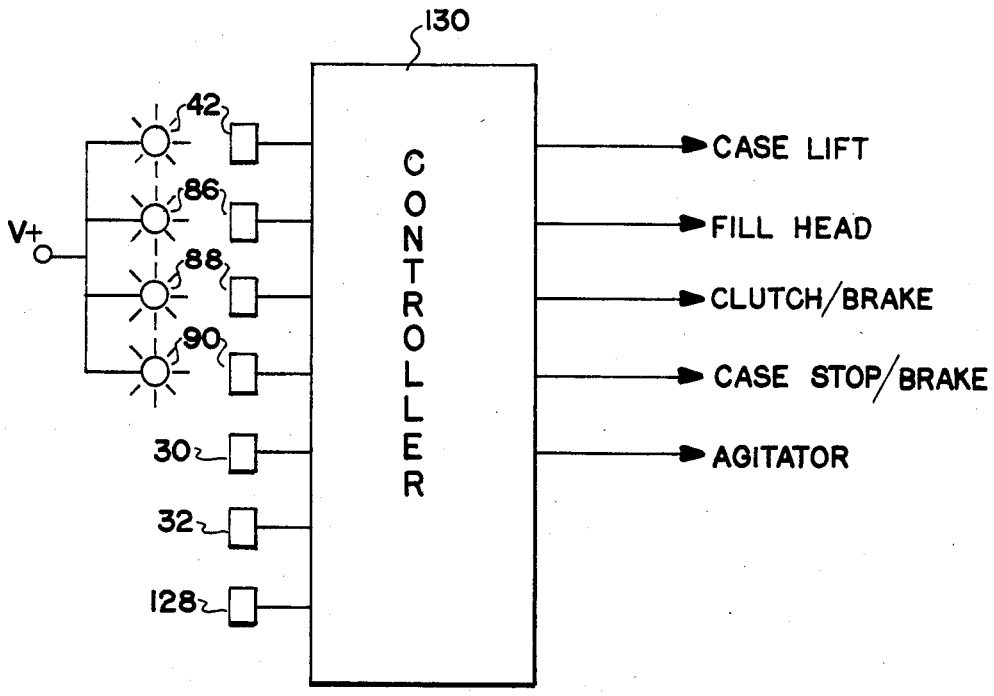
FIG. 3 is a block diagram schematic of the control circuitry of the invention.

As noted above, the cycle check switch 128 emits an output signal to a controller 130 as shown in FIG. 3, upon each packing cycle. At the time of the cycle check signal, the controller 130 also monitors the outputs of the photodetectors 42,86, 88,90, as well as the bottle supply switch 30. In the event that the conditions of these five switches are satisfied at the time of cycle check, the case lift 74 and fill head 34 are actuated to elevate and fill the case and to continue the next cycle as just described. However, in the event that a case is not present on the in-feed line to block the photodetector 86, or a case is not present in the staging area to block the photodetector 88, or a case is not present at the filling station to block the photodetector 90, or a full compliment of bottles is not present in the head 34 to block the photodetector 42, or bottles are not present on the bottle supply line as sensed by the switch 30, the controller 130 disengages the clutch 124 and applies the brake 126, both of which are operated off of the same pneumatic valve. In such a case, the chains 60,66 are stopped, but the chains 24,50 are caused to continue to operate. Accordingly, if the malfunction was that of insufficient bottle supply as sensed by the switch 30, the continuous operation of the conveyor chain 24 may allow that situation to be corrected. Similarly, if the fill head 34 was not filled with a full compliment of bottles, the continuous movement of the chain 24 could correct that situation. In like manner, if the malfunction was the result of the absence of cases at the in-feed, continuous operation of the chains 50 could correct that problem. For these types of errors, the system of the case packer 10 is self correcting. Only if the error occurs at the staging area or at the filling station, as by the absence of a case thereat, is it necessary for an operator to intervene and restart the operation.

It will also be noted that the controller 130 receives an input from the agitator switches 32. As noted above, in the case of an absence of bottles at the bottle supply switch 30, or the noting of a jam as by the agitator switch 32, the agitator can be caused to operate to break-up the jam. It will also be noted that the controller 130 is operative to actuate the case lift 74 and the fill head 34 to achieve the desired case packing function. It should be readily appreciated by those skilled in the art that the controller 130 may be readily designed in standard fashion using state of the art switches and relays. Such controllers for case packers and other article handling devices are generally well known in the art.

Thus it can be seen that the objects of the invention have been achieved by the structure presented hereinabove. While in accordance with the patent statutes only the best mode and preferred embodiment of the invention has been presented and described in detail, it will be understood that the invention is not limited thereto or thereby. Accordingly, for an appreciation of the true scope and breadth of the invention reference should be had to the appended claims.

What is claimed is:

1. A case packer, comprising:

a first conveyor assembly for receiving and transporting containers;

a stationary and non-translating packing head at an end of said first conveyor assembly for receiving the containers in an ordered arrangement; and a second conveyor assembly for receiving and transporting cases to a position beneath said packing head, said second conveyor assembly comprising first and second conveyor sections which are interconnected for exclusive and continuous operation together, said first and second conveyor sections being longitudinally aligned, said first conveyor section adapted for receiving cases from said second conveyor section, said first conveyor section cycling at a rate which is an integral multiple of the cycle rate of said second conveyor section, said first and second conveyor sections having means for engaging and pushing a rearward portion of the cases, the number of said means for engaging and pushing on said second conveyor section being an integral multiple of the number of said means for engaging and pushing on said first conveyor section.

2. The case packer according to claim 1 wherein said first and second conveyor sections comprise conveyor chains, and wherein said means for engaging and pushing comprise lugs connected to said chains.

3. The case packer according to claim 1 wherein said second conveyor assembly further includes a third conveyor section communicating with said second conveyor section, said third conveyor section adapted to receive and transport a linear arrangement of abutted cases and to singly feed said cases to said second conveyor section.

4. The case packer according to claim 3 wherein said third conveyor section further includes a case stop and a case brake, said case brake positioned before said case stop with respect to the direction of movement of said linear arrangement of cases.

5. The case packer according to claim 4 wherein release of said case stop effects application of said case brake.

6. The case packer according to claim 5 wherein said case brake is characterized by a time delay upon actuation thereof.

7. The case packer according to claim 3 wherein said first conveyor section includes first detector means for determining the presence of a case thereat, said second conveyor section includes a second detector means for determining the presence of a case thereat, and said third conveyor section includes a third detector means for detecting the presence of a case thereat.

8. The case packer according to claim 7 which further includes control means connected to said first, second, and third detector means for inhibiting operation of said first and second conveyor sections upon determination of the absence of a case at any of said first, second, or third conveyor sections.

9. The case packer according to claim 8 wherein said control means comprises a clutch and a brake connected to a drive shaft common to both said first and second conveyor sections, said clutch and brake mutually exclusively operating upon said drive shaft.

10. The case packer according to claim 9 wherein said packing head further includes fourth detector means for sensing the presence of a full compliment of containers within said packing head for deposit into a case, and wherein said first conveyor assembly further includes fifth detector means for determining the presence of containers within said first conveyor assembly, said control means being connected to said fourth and fifth detector means and operative to inhibit operation of said first and second conveyor sections upon determination of the absence of said full compliment of containers within said sensing head or the absence of containers in said first conveyor assembly.

11. The case packer according to claim 10 which further includes timing means connected to said control means, said timing means generating a signal to said control means, said control means monitoring each of said detector means upon receipt of said signal.

12. A packer for receiving an oncoming supply of cases and containers and for depositing said containers into said cases, comprising:

a container conveyor for receiving said containers at a first end thereof and transporting said containers to a stationary and non-translating fill head positioned at a second end thereof;

a continuously operating case in-feed conveyor for receiving said cases at a first end thereof and transporting said cases in an abutting linear order to a second end thereof;

a continuously operating staging conveyor having a first end thereof in case-receiving communication with said second end of said case in-feed conveyor for transporting said cases to a second end thereof;

a continuously operating case out-feed conveyor maintained beneath said fill head and having a first end thereof in case-receiving communication with said second end of said staging conveyor;

case stop means positioned at said seocnd end of said case in-feed conveyor for stopping and releasing said linear order of cases by selectively engaging and releasing a lead case of said linear order of cases; and case brake means adjacent said case in-feed conveyor for stopping and releasing said linear order of cases by selectively engaging and releasing a second case immediately adjacent said lead case, said brake means engaging said second case after release of said lead case by said case stop means.

13. The packer according to claim 12 wherein said brake means has a characteristic time delay between time of energization thereof and application of an associated shoe with said second case.

14. The packer according to claim 13 wherein said case stop means and case brake means are mutually exclusively operable.

15. The packer according to claim 13 wherein said staging conveyor and said case out-feed conveyor are interconnected and exclusively operable in tandem.

16. The packer according to claim 15 wherein a cycle time of said staging conveyor is an integral multiple of a cycle time of said case out-feed conveyor.

17. The packer according to claim 15 wherein said staging conveyor and said case out-feed conveyor are characterized by lugs thereon for engaging and moving individual cases therealong.

18. The packer according to claim 13 which further includes a sensing means associated with each of said case in-feed, staging, and case out-feed conveyors for determining the presence or absence of a case at the associated conveyor.

19. The packer according to claim 18 which further includes control means connected to said staging and out-feed conveyors and responsive to said sensing means to inhibit operation of said staging and out-feed conveyors upon sensing of the absense of a case at any of said in-feed, staging, or out-feed conveyors.

20. The packer according to claim 19 wherein said control means comprises a clutch and a brake connected to a common drive shaft of said staging and out-feed conveyors.

* * * * *